United States Patent [19]

Elkins

[11] Patent Number: 4,884,304

[45] Date of Patent: Dec. 5, 1989

[54] BEDDING SYSTEM WITH SELECTIVE HEATING AND COOLING

[75] Inventor: William Elkins, San Jose, Calif.

[73] Assignee: Life Support Systems, Inc., Moutain View, Calif.

[21] Appl. No.: 250,778

[22] Filed: Sep. 28, 1988

[51] Int. Cl.[4] ..... A47C 21/04

[52] U.S. Cl. ..... 5/421; 5/422; 5/449; 5/453; 62/261; 165/46

[58] Field of Search ..... 5/421, 422, 423, 284, 5/453, 455, 449, 451, 450, 482, 500; 62/261; 165/46; 128/400

[56] References Cited

U.S. PATENT DOCUMENTS

| | | | |
|---|---|---|---|
| 697,279 | 4/1902 | Schmied | 5/421 |
| 1,121,277 | 12/1914 | Mitchell | 5/421 |
| 2,093,834 | 9/1937 | Gaugler | 5/423 |
| 2,250,325 | 7/1941 | Barnes | 165/46 |
| 2,504,308 | 4/1950 | Donkle | 5/485 |
| 2,753,435 | 7/1956 | Jepson | 5/423 |
| 2,978,225 | 4/1961 | Dallas | 5/482 |
| 4,132,262 | 1/1979 | Wibell | 5/421 |

*Primary Examiner*—Alexander Grosz
*Attorney, Agent, or Firm*—Thomas M. Freiburger

[57] ABSTRACT

A bedding system has provision for heating or cooling a person and for applying the heating or cooling only in areas of the bed where the person is located. A sealed three-ply heat transfer and insulating device covers the mattress, below the contour sheet or other covering which comes in contact with the person's body. A wicking contour sheet or other cover may optionally be used, capable of absorbing any condensation on the surface of the three-ply device. Between the lower two plies of the three-ply material is channeled flow of coolant liquid, at a regulated temperature close to human skin temperature. Above these two plies. i.e. between the middle ply and the upper ply, is a sealed envelope containing slightly pressurized air. A light weight, well-insulated comforter is also recommended to isolate the sleeper from the thermal ambient environment.

16 Claims, 2 Drawing Sheets

BEDDING SYSTEM WITH SELECTIVE HEATING AND COOLING

BACKGROUND OF THE INVENTION

The present invention relates to bedding systems, and particularly to bedding systems which heat or cool a person lying in a bed. The invention also relates to methods for selectively heating and cooling a person lying in a bed.

Several bedding devices have been developed previously for providing heat to a person lying in a bed. Electric blankets containing electric heating elements have been used for many years to warm the occupant of a bed. Cooling blankets have also been proposed such as the blanket disclosed in U.S. Pat. No. 4,660,388 to Greene. Greene is directed to a cooling cover having an inflatable pad with plenum chambers at opposite ends. Cool air is generated in a separate unit and directed to the pad and out a number of small air jets on the underside of the pad and against the body of the user.

Cooling devices other than blankets have also been proposed. U.S. Pat. No. 4,006,604 to Seff discloses an air conditioned pillow into which cool air is directed. The cold air passes through layers of permeable cushion material to cool the pillow and its user.

Blankets which provide heat to or remove heat from the user have also been proposed. U.S. Pat. No. 2,504,308 to Donkle is directed to a heating and cooling cover having an embedded coil which is used alternatively as either the evaporator or condenser of a refrigerating system. Another coil located externally from the cover is used alternatively as either the condenser or evaporator. In the Donkle patent the cover or blanket utilizes refrigerant gas in its coils to effect heating or cooling as desired.

U.S. Pat. No. 3,738,702 to Jacobs discloses a device for heating or cooling a person occupying a seat such as a car seat. In the Jacobs device, heating or cooling is effected by cycling a volatile fluid through closed channels in the seat or a portable pad capable of being placed on the seat.

Several problems are inherent in the prior devices. Electric blankets provide sufficient heating, but are incapable of alternatively heating or cooling the user and present a fire hazard. Electric blankets also have no means for selectively providing heat only to the body of the user and providing insulation for the remainder of the heating elements.

The cover disclosed in the Greene patent referenced above actually directs cool air from the inflatable pad onto the user and thus cools the user by convection, which tends to be inefficient. Also, cool air escapes from the pad through each air jet regardless of the position of the user under the cover, with no means for selectively cooling the user.

The cover disclosed in the Donkle patent also heats or cools the entire cover and therefore areas where the user is not located. Thus Donkle also cannot selectively heat or cool the user.

The present invention provides heating or cooling to the occupant of a bed by selective conduction, while insulating the heating or cooling medium in areas where the user is not lying.

SUMMARY OF THE INVENTION

The present invention provides a bedding system and methods for selectively heating or cooling a person lying in a bed while insulating the heating or cooling medium in areas where the user is not lying. The selective heating or cooling is by conduction.

The system includes a mattress cover device which is fitted over the mattress of a bed, and a unit for heating or cooling a liquid heat transfer medium. The mattress cover device contains liquid flow channels which may be substantially coextensive with the upper surface of the mattress. Heated or cooled liquid is circulated through the channels to provide or receive heat. A gas envelope is preferably also included in the mattress cover device, formed of flexible, gas-impermeable material and positioned over the liquid flow channels. The gas envelope contains a gas at slightly above atmospheric pressure so that when there is no one in the bed, the upper layer of the gas envelope essentially does not touch the liquid flow channels below. The bedding system may also include a pillow cover constructed of the three ply material with liquid flow channels and gas envelope.

When a person lies on the mattress cover device, the area of the outer, upper layer of the gas envelope contacted by the person's body is pressed down into contact with the liquid flow channels. This contact allows heat to be conducted to or from the person's skin through the layer of material forming the liquid flow channel means and through the layer of material which forms the gas envelope. Heat may be transferred to or from the person's skin as desired by controlling the temperature of the liquid circulated through the liquid flow channels. In portions of the mattress cover device where the person is not lying, the material forming the upper layer of the gas envelope remains out of contact with the liquid flow channels, and the gas and space in the gas envelope effectively insulate those portions of the liquid flow channels from the environment. Alternatively, the liquid flow channels may be effectively insulated from the environment without the gas envelope but with a well-insulated comforter covering both the sleeper and the liquid flow channels.

The bedding system also includes a device for heating or cooling the liquid heat transfer medium, circulation means for circulating the liquid, and temperature control means for controlling the temperature of the liquid at the desired level.

It is a broad object of the present invention to provide a bedding system which can selectively provide heating or cooling for a person lying in a bed. Another object is to insulate the heating or cooling system from ambient losses in areas of the bed where the person is not lying. The invention also includes methods for selectively heating or cooling a person lying in a bed.

These and other objects, advantages and features of the invention will be apparent from the following description of a preferred embodiment, considered along with the accompanying drawings.

DESCRIPTION OF PREFERRED EMBODIMENTS

Figure 1:
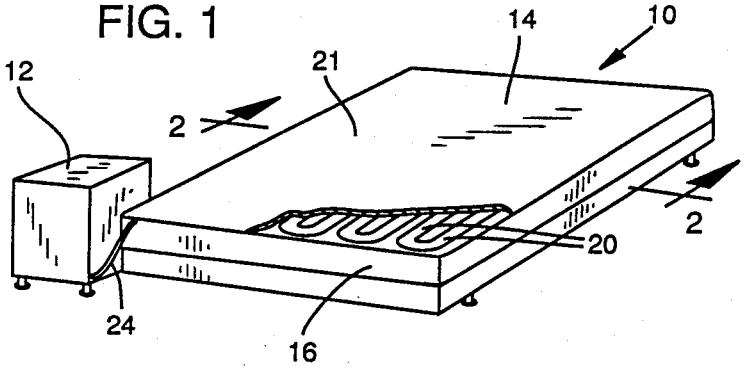
FIG. 1 is a perspective view of one embodiment of the present bedding system partially cut away to show the components of the mattress cover.
Figure 2:
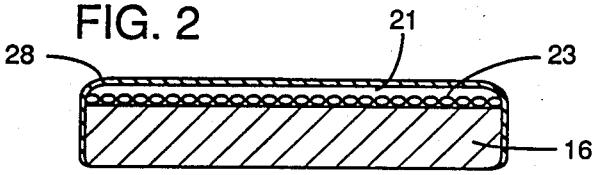
FIG. 2 is a sectional view taken along the line 2—2 in FIG. 1.
Figure 3:
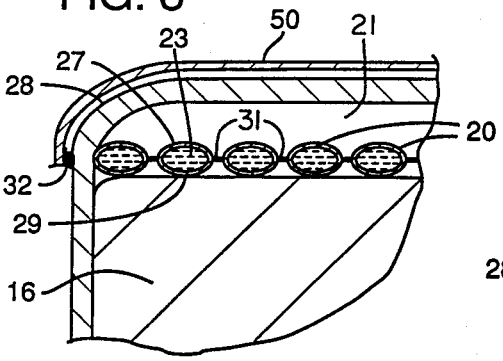
FIG. 3 is a detail of a portion of the section shown in FIG. 2, and indicating an optional additional element.
Figure 4:
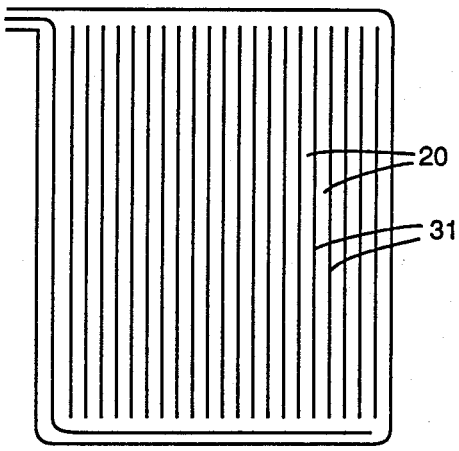
FIG. 4 is a plan view of the mattress cover with the gas envelope removed

In the drawings, FIG. 1 shows a bedding system 10 in accordance with the present invention, including a temperature control unit 12 and a mattress cover device 14, which is positioned over a mattress 16. Other bedding such as a conventional fitted or flat mattress pad (not shown) may be used between the mattress cover device 14 and the mattress. A conventionally fitted or flat sheet (not shown) may also be used over the mattress cover As best illustrated in FIGS. 2, 3 and 4, the mattress cover device 14 includes liquid flow channels 20 and preferably a gas envelope or plenum space 21 located above the liquid flow channels The multiplicity of liquid flow channels 20 are interconnected to form one or more circulation paths. In the illustrated embodiment (see FIG. 4), the flow channels run from the head to the foot of the bed; however, other flow channel patterns or configurations can be employed. Regardless of the pattern of flow channels employed, the area covered preferably should be substantially coextensive with the upper surface of the mattress.

Figure 6:
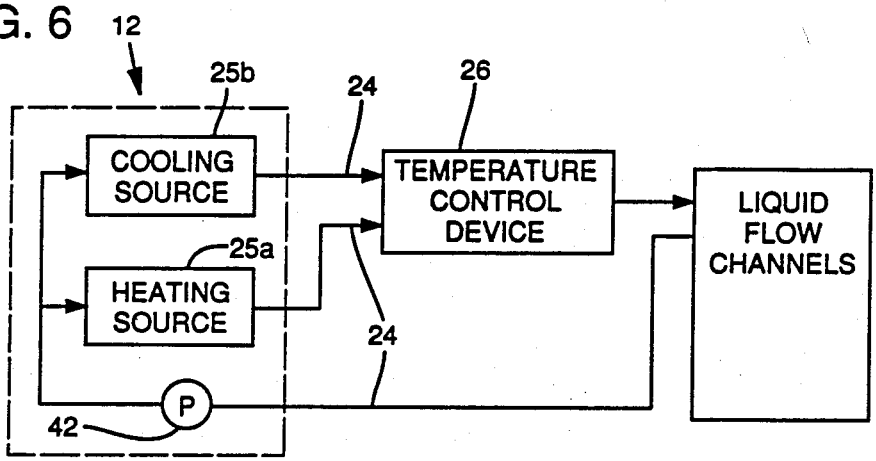
FIG. 6 is a schematic block diagram type view showing a temperature control means feeding fluid flow channels of the mattress cover device.

A liquid heat transfer medium 23 is circulated through the flow channels. As shown in FIG. 6, the liquid circulates from heating/cooling sources 25*a* and 25*b* included in the Unit 12 shown in FIG. 1 (which may be in the form of or built into a nightstand or may fit under a bed) through flexible connector tubing 24 to a temperature control device 26 and then to the liquid flow channels 20, then through the channels and then back to the heating/cooling devices. The temperature control device may be incorporated directly into the unit 12 or may be remote as shown in FIG. 6.

As best seen in FIG. 3, the gas envelope 21 is formed by two sheets 27 and 28 of fluid-impermeable material sealed together at peripheral edges, with at least the upper sheet 28 being flexible. A gas, preferably air, is contained within the gas envelope at slightly above atmospheric pressure, preferably between 2 and 3 inches of water, so as to separate the flexible upper sheet 28 from the lower sheet 27 and to maintain the insulating space. Thus, when the bed is empty, the gas envelope forms a gas barrier over the liquid flow channel means, insulating the liquid in the channels from any substantial heat transfer. The gas envelope may also include a pressure regulator (not shown) for regulating the gas pressure in the envelope within the desired levels with respect to the prevailing ambient pressure.

In the illustrated embodiment, the mattress cover device is made of three plies of flexible material such as polyurethane coated nylon fabric. The middle and lower plies 27 and 29, respectively, are sealed together along various lines 31 to form the liquid flow channels such as in the construction Flexitherm manufactured by Life Support Systems, Inc. and described at least in part in U.S. Pat. No. 3,830,676. The upper and middle plies are sealed together at a peripheral seam 32 to form the gas envelope. Thus in this embodiment the lower and middle plies of the three-ply material form the liquid flow channels, and the upper and middle plies form the gas envelope.

Figure 5:
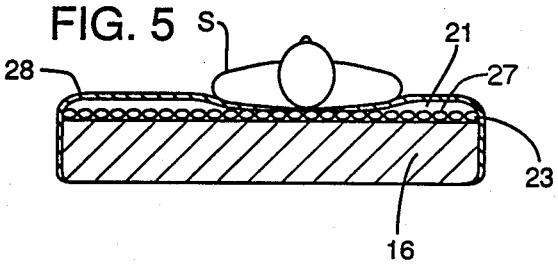
FIG. 5 is a sectional view similar to FIG. 2 with a person lying on the bed.

As illustrated in FIG. 5, when a person S lies on a bed fitted with the present bedding system, the weight of his or her body presses an area of the upper sheet 28 of the gas envelope down into contact with the middle sheet or ply 27 and therefore with the exterior of the liquid flow channels, eliminating the gas space between the flow channels and the upper sheet of material in this area only. The contact between the upper sheet of the gas envelope and the middle sheet, and the resulting absence of insulating gas, facilitates conductive heat transfer between the person's kin and the liquid in the liquid flow channels The portions of the upper sheet 28 outside the area where the person is lying are not pressed down into contact with the liquid flow channels (and in fact may be further separated), leaving the insulating gas barrier intact in those areas. It can therefore be seen that the bedding system transfers heat between the person in the bed and the liquid in the liquid flow channels (in either direction) by conduction while minimizing heat transfer to or from the liquid in areas where the person is not lying. In this way the present bedding system selectively heats or cools the person lying in the bed, regardless of his position in the bed, while insulating the remainder of the heating or cooling element of the mattress cover and reducing energy consumption accordingly.

The temperature control unit 12, as indicated in FIG. 6, includes the heating and cooling means 25*a* and 25*b*, and a circulating means or pump 42. It may also include the temperature control device 26. In a preferred embodiment the temperature control device 26 is remotely located from the cooling/heating sources 25*a*, 25*b* nd outside the unit 12. The unit 12, whether or not it includes the control device 26, may be as shown in FIG. 1, i.e. incorporated in a nightstand by the bed. However, in other embodiments the heating/cooling device may be of such size and shape that it may be conveniently located under the bed where the bed is raised above the floor by a bed frame.

The heating/cooling source 25*a*, 25*b* alternatively heats or cools the liquid heat transfer medium as desired. When the user desires to be warmed, the liquid heating/cooling medium 23 is heated to slightly above skin temperature, and when cooling is desired the liquid is cooled to slightly below skin temperature. In applications or environments where only heating or cooling and not both will be required, the heating/cooling source 25*a*, 25*b* may be replaced by a heater or a cooler.

The circulating unit 42 comprises a pump for circulating the liquid through the liquid flow channels and the heating/cooling means. In the preferred embodiment the temperature control device 26 controls the temperature of the liquid to the desired level of heating or cooling by mixing warm and cool fluids to a ratio selected by the person.

The control device 26 in another embodiment (not shown) may be incorporated directly into the heating-/cooling device and may be thermostatically controlled or controlled remotely by electrical signals.

Figure 8:
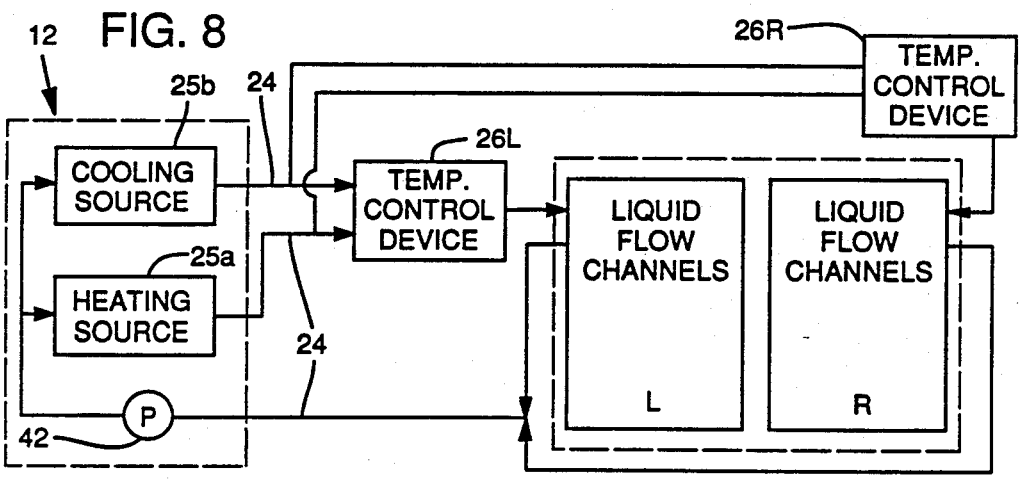
FIG. 8 is a schematic view similar to that of FIG. 6, showing another embodiment with two separately controlled mattress covers.

It should be understood that, although a single mattress cover device 14 is shown for the entire bed, with a single temperature control system, two separate mattress cover devices can be included, i.e. a left side and a right side for two persons sleeping in the bed, as shown schematically in FIG. 8. The temperature control unit 12 can then be modified to include two separate temperature control devices 26L and 26R, one for each side of the bed. The temperature control unit 12 can still include a single heating source 25*a* and a single cooling source 25*b*, both of which deliver heated or cooled fluid to two different temperature control devices or liquid mixing devices 26L and 26R, for delivery to the respective mattress covers at the left and right sides of the bed. With the preferred temperature control comprising mixing of heated and cooled liquid to provide liquid at the correct temperature exiting the temperature control device to enter the liquid flow channels, the system is readily adaptable to controlling two separate individual mattress cover devices, with individual temperature control devices 26L and 26R.

In one preferred embodiment the bedding system includes a wicking cover sheet 50 (FIG. 3) which covers the mattress cover device. When the bedding system is used for cooling in warm, humid climates, a small amount of condensation may form on the upper outside surface of the gas envelope 21, despite the insulation provided by the envelope. In such cases the wicking sheet may be used to draw condensate moisture away from the mattress cover device to be evaporated into the air.

In another preferred embodiment the bedding system includes a highly insulative cover or comforter (not shown) for use in extreme hot or cold environments, positioned over the person to insulate the person from the environment.

Figure 7:
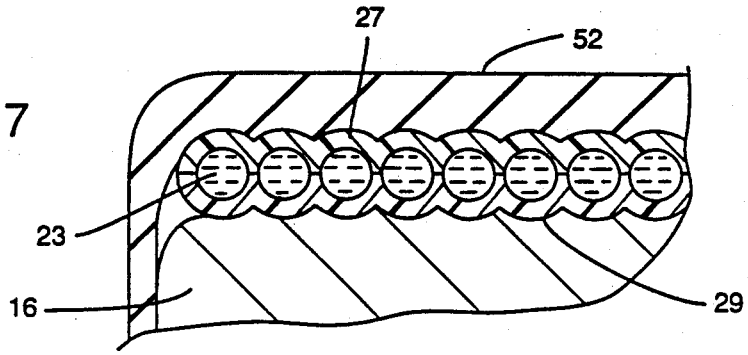
FIG. 7 is a sectional view similar to that of FIG. 3, showing an alternate embodiment.

In an alternative embodiment shown in FIG. 7, another insulator 52 is included as a primary insulator, to insulate the liquid flow channels from the environment. In this embodiment only the lower two plies 27 and 29 are included, forming the liquid flow channels 23 but without any gas envelope The upper layer 28 (FIG. 3) is eliminated. The insulator 52 is flexible and compressible and acts to some extent as the air envelope acts, although not as efficiently. For example, the insulator 52 may be a thin flexible open celled foam blanket.

It should be understood that the invention also encompasses the two-ply mattress cover device without the air envelope and with or without an insulating comforter over the sleeping person and flow channels. The system with liquid cooled or heated flow channels in a mattress cover, with temperature control means for controlling the temperature of the liquid flowing through the channels, is an important aspect of the invention.

Pillow covers in accordance with the invention may be constructed similarly to the mattress covers shown in FIGS. 1–5 and 7, and may be heated and/or cooled in the same way.

The above described preferred embodiments illustrate the principles of the invention but are not intended to be limiting of its scope. Other embodiments and variations to these preferred embodiments will be apparent to those skilled in the art and may be made without departing from the scope of the invention as defined in the following claims.

I claim:

1. A bedding system for use in a bed for selective conductive cooling and heating of a person in the bed, comprising:

a mattress cover device adapted to lie over a mattress, with or without other bedding materials between, and beneath the person in the bed, the mattress cover device including liquid flow channel means for circulation of cooling/heating liquid, and a gas envelope space just above the liquid flow channel means, with a flexible, substantially gas-impermeable sheet covering the liquid flow channel means to form the gas envelope and with gas at slightly above atmospheric pressure in the gas envelope, such that when the person puts weight on an area of the mattress cover device, the flexible sheet comes into contact with the liquid flow channel means, effecting heat exchange with the person's skin, while leaving remaining portions of the flexible sheet above and out of contact with the liquid flow channel means thereby insulating the liquid in the flow channel means in such remaining portions, and cooling/heating temperature control means connected to the liquid flow channel means for circulating the cooling/heating liquid through the liquid flow channel means as required and as selected by the person.

2. A bedding system as in claim 1, wherein the mattress cover device is comprised of a three-ply material, with a bottom and middle ply forming the liquid flow channel means and the gas envelope being formed between an upper ply and the middle ply.

3. A bedding system as in claim 1, wherein the gas in the gas envelope is air.

4. A bedding system as in claim 1, including a pillow cover device constructed similarly to the mattress cover device.

5. A bedding system as in claim 1, further including wicking sheet means in contact with the exterior surface of the gas envelope for drawing out condensate moisture to be evaporated.

6. A bedding system as in claim 5, wherein the wicking sheet means is positioned on top of the mattress cover device and beneath the body of the person in the bed.

7. A bedding system as in claim 1, wherein the pressure in the gas envelope is in the range of 2 to 3 inches of water.

8. A bedding system as in claim 1, wherein the cooling/heating control means is incorporated in a night stand.

9. A bedding system as in claim 1, wherein the cooling/heating temperature control means includes heating and cooling sources of such size and shape that they can be located below the bed, with the bed raised above the floor by a bed frame.

10. A bedding system as in claim 1, wherein the cooling/heating temperature control means include a first unit containing cooling and heating sources and a second unit remote from the first unit and comprising a temperature control device with selection means enabling the user to select an appropriate degree of heating or cooling from the cooling and heating sources, with conduits connecting the first unit to the second unit.

11. A bedding system as in claim 10, wherein the selection means comprises liquid mixing means for appropriately mixing heated and cooled liquid.

12. A bedding system for selectively cooling a person lying in a bed, comprising:

mattress cover means, adapted to cover the mattress of the bed, for cooling a person in the bed, the mattress cover means having liquid flow channel means for circulation of a liquid cooling medium, a gas envelope formed by flexible, gas impermeable material and positioned above the liquid flow channel means, the gas envelope containing a gas at slightly above atmospheric pressure such that when the weight of a person's body rests on the mattress cover means, portions of the gas envelope are pressed down and collapsed, effecting conductive heat exchange between the liquid flow channel means and the person's skin, while leaving remaining portions of the gas envelope inflated, thereby insulating the liquid cooling medium from appreciable heat exchange in such remaining portions, cooling means connected to the liquid flow channel means for cooling the liquid cooling medium to be circulated through the liquid flow channel means, manually settable control means for adjusting the cooling means to the desired temperature level for comfort of the person, and circulating means for circulating the liquid cooling medium through the liquid flow channel means and the cooling means.

13. The bedding system of claim 12, wherein the liquid flow channel means has flow channels which cover substantially the entire area of the upper surface of the mattress and through which the liquid cooling medium can be circulated.

14. The bedding system of claim 12, wherein the mattress cover means is comprised of a three-ply material, the liquid flow channel means being formed by middle and lower plies and the gas envelope being formed by the middle and an upper ply.

15. The bedding system of claim 12, including a wicking sheet between the person's body and the mattress cover means for drawing out condensate moisture on the mattress cover means to be evaporated.

16. The bedding system of claim 12, further including pressure regulator means for regulating the pressure of the gas in the gas envelope.

* * * * *